US007892058B1

(12) United States Patent
Echecopar

(10) Patent No.: US 7,892,058 B1
(45) Date of Patent: Feb. 22, 2011

(54) REINFORCED SURFING BOARDS

(76) Inventor: Carlos Echecopar, Juan Fanning 557, Miraflores, Lima (PE)

( * ) Notice: Subject to any disclaimer, the term of this patent is extended or adjusted under 35 U.S.C. 154(b) by 211 days.

(21) Appl. No.: 12/392,650

(22) Filed: Feb. 25, 2009

(51) Int. Cl.
*B65D 19/00* (2006.01)

(52) U.S. Cl. ..... 441/74; 441/65

(58) Field of Classification Search ..... 441/65, 441/74, 79; 114/357, 356, 39.14
See application file for complete search history.

(56) References Cited

U.S. PATENT DOCUMENTS

| | | | | |
|---|---|---|---|---|
| 4,798,549 | A * | 1/1989 | Hirsch | 441/74 |
| 2006/0292941 | A1* | 12/2006 | Bert | 441/65 |
| 2008/0210137 | A1* | 9/2008 | Cox | 108/51.3 |

* cited by examiner

*Primary Examiner*—Ed Swinehart
(74) *Attorney, Agent, or Firm*—Sanchelima & Associates, P.A.

(57) ABSTRACT

A surfing board and method for manufacture that include the cutting and bending of a buoyant material to a flat arch with a concave upperside and a convex underside to define an elongated body. T-shaped longitudinal cutouts extend from one end to the other along the upperside and underside, respectively. The T-shaped longitudinal cutouts are kept at a substantially parallel and spaced apart relationship with respect to each other with the vertical leg of the T-shaped cutouts coplanarly disposed opposite to each other and the crossed legs of the T-shaped cutouts substantially flush with the upperside and underside, respectively. Two elongated reinforcement core members are longitudinally coextensive with the body and being mounted within, and conforming to, the cutouts that are kept at a substantially parallel and spaced apart relationship with respect to each other. A predetermined degree of calibrated rigidity is given to the body conveying to a surfer the right combination of support and maneuverability of the board. A cover film to provide a substantially smooth surface for said body and exposed core members is applied.

10 Claims, 6 Drawing Sheets

REINFORCED SURFING BOARDS

BACKGROUND OF THE INVENTION

1. Field of the Invention

The present invention relates to reinforced surfing boards.

2. Description of the Related Art

Several designs for reinforced surfing boards have been designed in the past. None of them, however, include elongated structural reinforcement core members having "T"-shaped cross-sections that are recessed and extend longitudinally along substantially the entire surfing board. The body of the board being of a buoyant material, such as a polymer of styrene, does not have the necessary rigidity for a surfing board. The present invention provides a solution that includes a low weight board with good rigidity that is particularly desirable for surfing boards, body boards, windsurfing boards, and similar devices.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
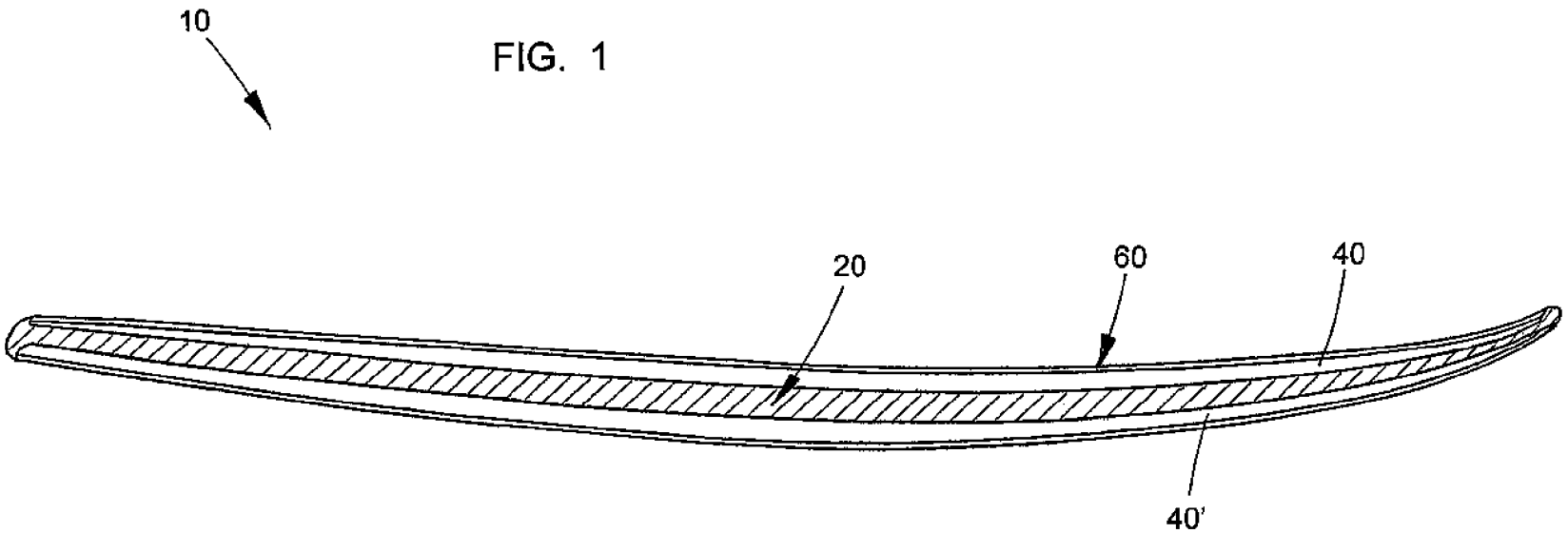
FIG. 1 represents an elevational cross-sectional view of an embodiment for a surfing board subject of the present application.
Figure 2:
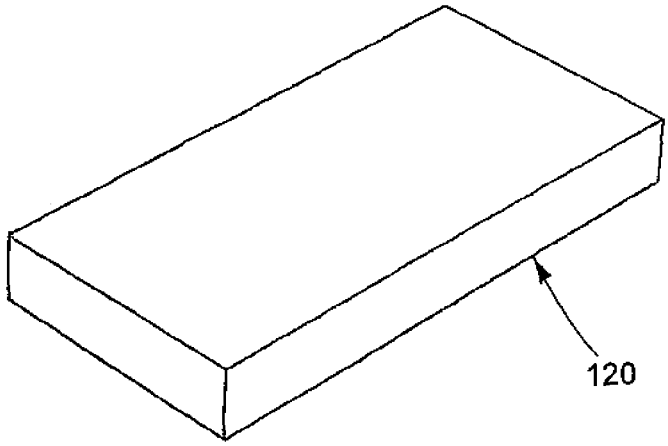
FIG. 2 illustrates an isometric view of a virgin polystyrene block.
Figure 1A:
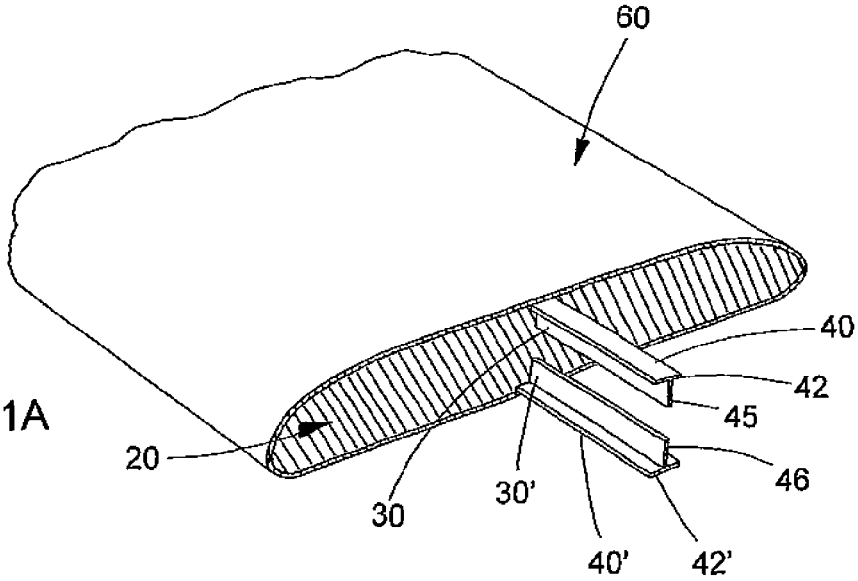
FIG. 1A shows an isometric cross-sectional representation of a portion of a surfing board's central area with the PVC or fiberglass outer layer or cover to illustrate the position of the recessed reinforcement core member.
Figure 5:
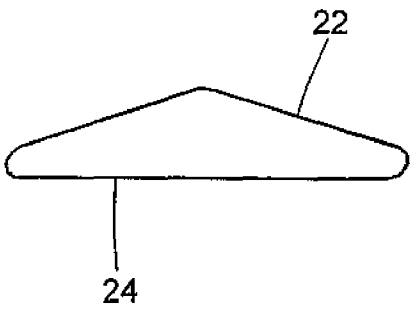
FIG. 5 is a front elevational view of the surfing board's body shown in the previous figure.
Figure 4:
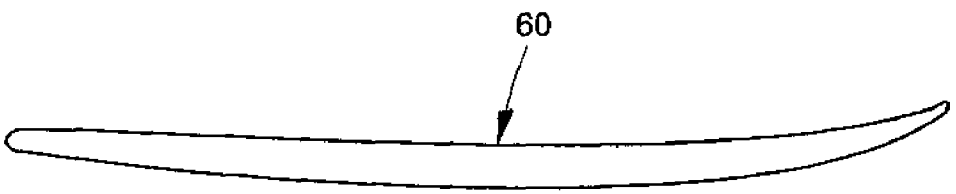
FIG. 4 is a side elevational view of the cut block shown in the previous figure after it has been bent defining the body of the surfing board.
Figure 3:
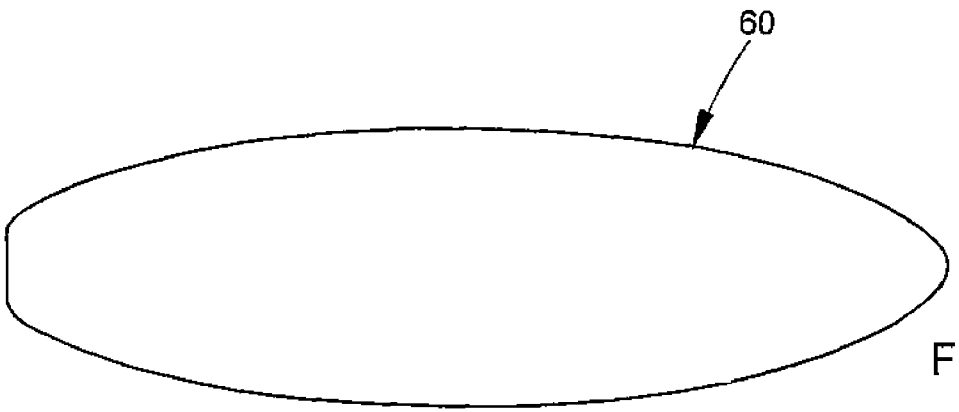
FIG. 3 is a top view of the block shown in the previous figure after it has been cut to a predetermined shape.
Figure 6:
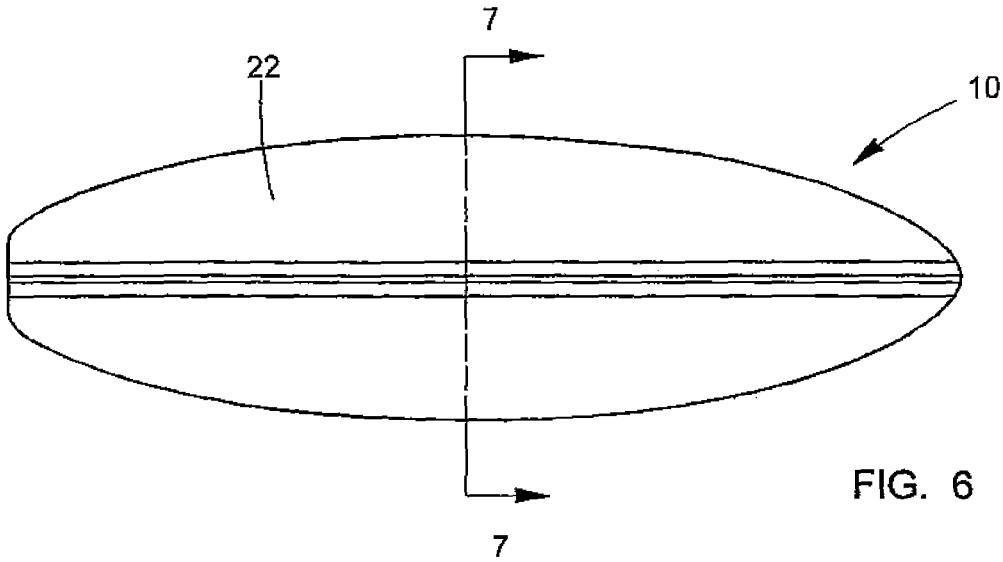
FIG. 6 is a top view of the board shown in the previous two figures after a central T-shaped longitudinal cut is performed along the upperside and underside (not shown).
Figure 7:
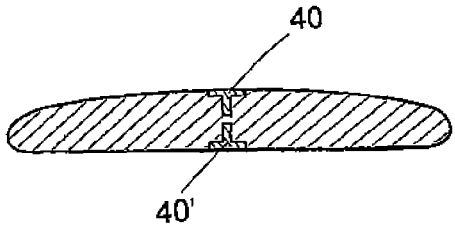
FIG. 7 shows a cross-section of the board's body shown in the previous figure taken along line 7-7.
Figure 7A:
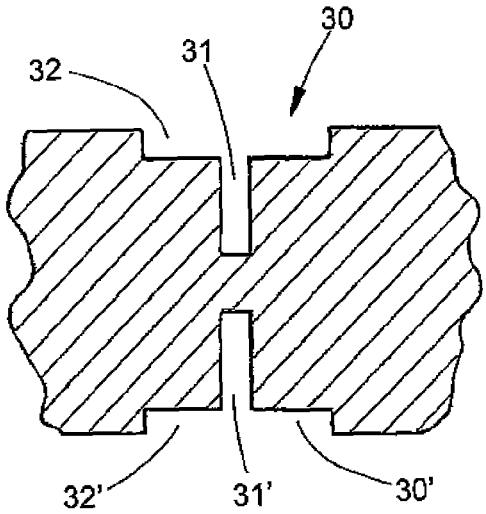
FIG. 7A is an enlarged cross-sectional representation of the T-shaped longitudinal cutout shown in the previous figure.
Figure 8:
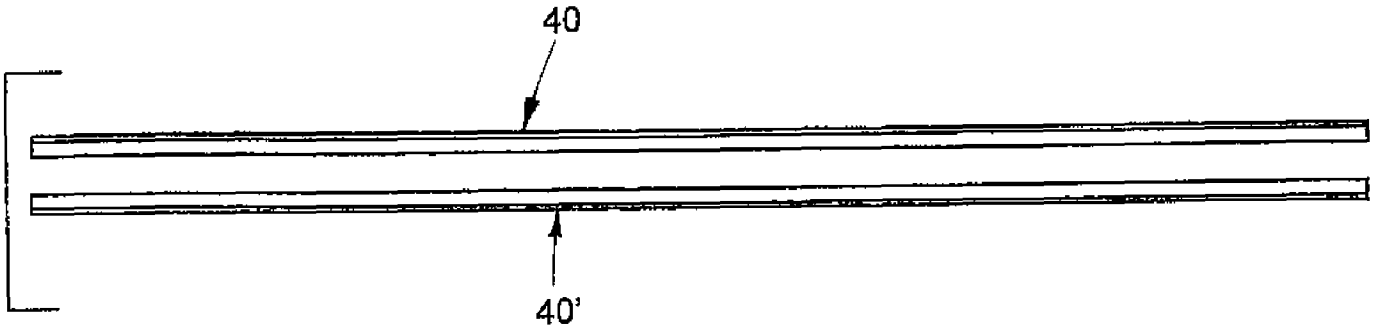
FIG. 8 is an elevational view of virgin reinforcement T-shaped core members 40 and 40'.
Figure 9:
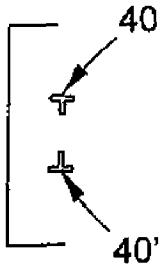
FIG. 9 is an end view of T-shaped core members 40 and 40'.
Figure 10:
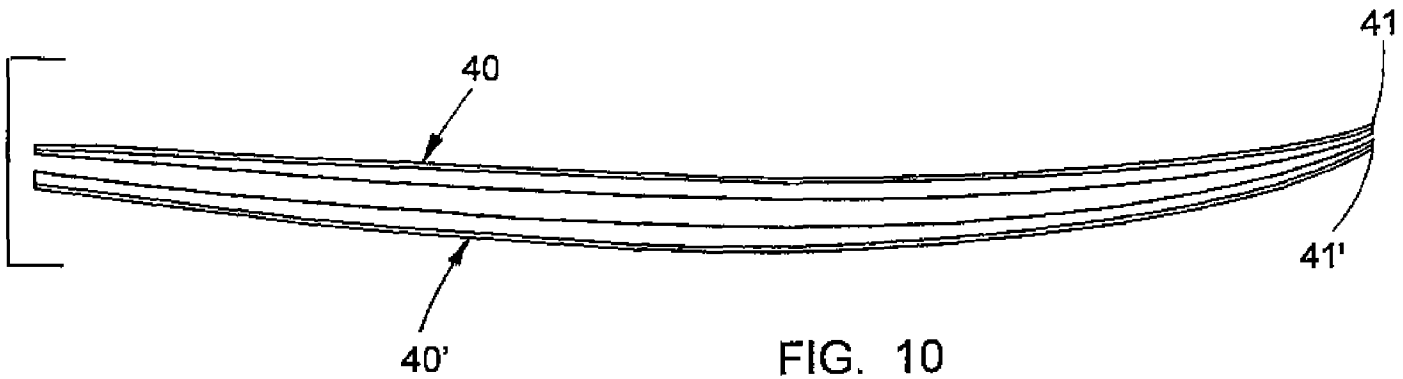
FIG. 10 is an elevational view of the core members shown in the previous two figures after the web portions at the ends have been reduced and a predetermined bend introduced.
Figure 11:
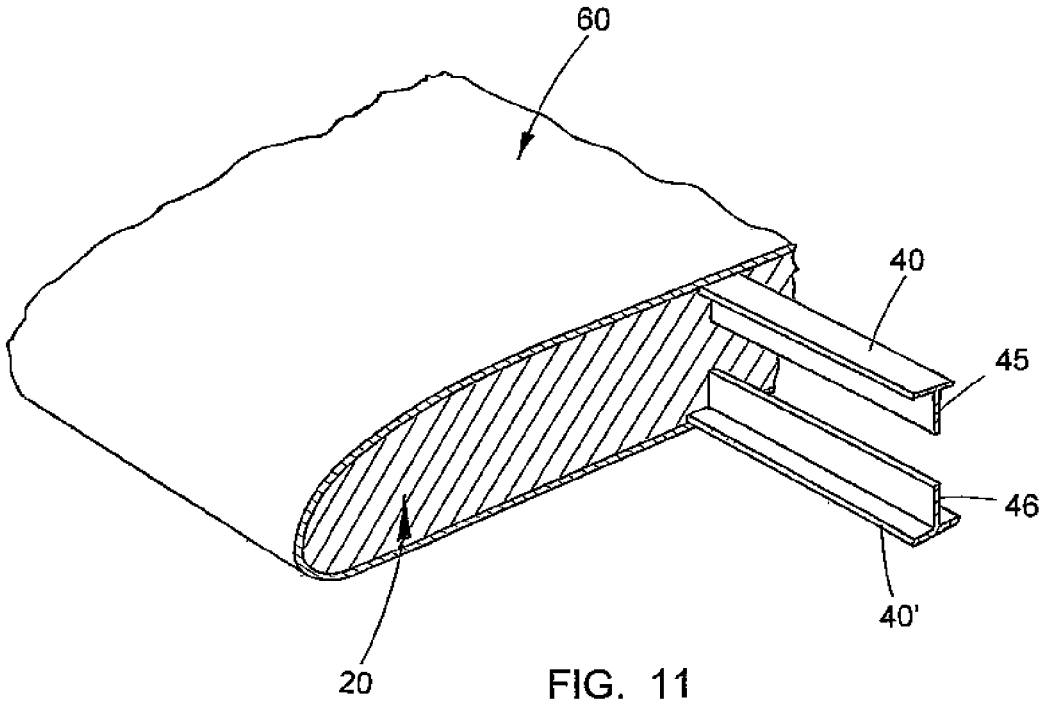
FIG. 11 is an isometric cross-sectional representation of the surfing board showing the position of the different elements.

Referring now to the drawings, where the present invention is generally referred to with numeral 10, it can be observed that it basically includes body 20 made out of an open cell plastic material, such as a polymer of styrene (polystyrene). Body 20 is elongated and given a hydrodynamic shape after cutting and bending a virgin block of polystyrene. Body 20 has concave upperside 22 and convex underside 24, with longitudinal T-shaped cutouts 30; 30' extending substantially the entire length of body 20. T-shaped cutouts 30; 30' each include web cavities 31; 31' and perpendicular flange cavities 32; 32'. T-shaped cutouts 30; 30' extend parallel and spaced apart from each other with web cavities 31; 31' coplanarly disposed at a spaced apart relationship with respect to each other. One of the characteristics of body 20 is that it is buoyant.

Elongated reinforcement T-shaped core members 40; 40' extend longitudinally substantially the entire length of body 20. Members 40; 40' are made out of a rigid and light material, such as aluminum. Members 40 and 40' provide rigidity to board 10. Members 40; 40' have a T-shaped cross-section and are bent to conform to cutouts 30 and 30' along upperside 22 and underside 24, respectively, of body 20. Members 40 and 40' include web elements 41; 41' and flange elements 42; 42', respectively. The ends 45; 46 of members 40 and 40' have a reduced dimension for web elements 41; 41' to permit them to stay at a spaced apart relationship without touching. Members 40 and 40' provide the necessary rigidity to body 20 while still keeping the board 10 buoyant overall. Rigid materials such as aluminum are preferred because of their light weight. A PVC (polyvinyl chloride) layer or cover 60 is applied to cover exposed members 40 and 40'. Cover 60 can also be implemented with fiberglass and epoxy resin.

To fabricate surfing boards 10, body 20 is cut from a virgin block 120 of a buoyant material such as a polymer of styrene (polystyrene) and bent to form a flat arch with a concave upperside and a convex underside. The front end is cut to provide a hydrodynamic shape intended to reduce the board's resistance to the waves in a body of water. Then, longitudinally extending T-shaped cutouts 30; 30' are cut substantially along the entire length of body 20. The web portions of the T-shaped cutouts being spaced apart are coplanarly disposed. The elongated reinforcement T-shaped core members 40; 40' are mounted within cutouts 30; 30'. Members 40; 40' are preferably glued to body 20 using epoxy compounds.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A surfing board, comprising:

A) an elongated arched body having a concave upperside and a convex underside, said body having first and second ends and being made out of a buoyant material, and further including first and second T-shaped longitudinal cutouts having a web portion and a perpendicularly extending flange portion, said cutouts extending from said first end to said second end centrally along said upperside and underside, respectively, and said first and second T-shaped longitudinal cutouts kept at a substantially parallel and spaced apart relationship with respect to each other along substantially the entire length of said body except the area adjacent to said first and second ends whether the separations of said first and second cutouts is reduced and with the web portions of said T-shaped first and second cutouts coplanarly disposed opposite to each other and the flange portions of said T-shaped cutout substantially flush with said upperside and underside, respectively;

B) first and second elongated reinforcement T-shaped core members substantially longitudinally coextensive with said body from said first end to said second end, said first and second core members having each a flange element and a web element being mounted within, and conforming to, said flange and web portions of said first and second cutouts, respectively, so that a predetermined degree of rigidity is given to said body; and C) a cover film to provide a substantially continuous surface to said body and exposed core members.

2. The surfing board set forth in claim 1 wherein said buoyant material is a polymer of styrene.

3. The surfing board set forth in claim 2 wherein said core member is made out of aluminum.

4. The surfing board set forth in claim 3 wherein said body has a hydrodynamic shape.

5. The surfing board set forth in claim 4 further including a sufficient and effective amount of epoxy material to glue said first and second elongated reinforcement T-shaped core members to said body where said longitudinal cutouts are defined.

6. A method for fabricating surfing boards, comprising the steps of:

A) selecting a virgin block of a buoyant material having predetermined dimensions;

B) cutting and bending said block to form a body having a predetermined longitudinal arch shape defining first and second ends, an upperside and an underside;

C) cutting first and second longitudinally extending T-shape cutouts centrally along said upperside and underside, respectively, said first and second T-shape cutouts extending substantially parallel to each other and having their vertically legs coplanarly disposed at a spaced apart relationship with respect to each other;

D) mounting first and second cooperating elongated reinforcement T-shaped core members within said first and second cutouts to provide a predetermined degree of calibrated rigidity to said body; and E) covering said body and core members to provide a substantially smooth surface.

7. The method set forth in claim 6 wherein said buoyant material is a polymer of styrene.

8. The method set forth in claim 7 further wherein said core members are made out of aluminum.

9. The method set forth in claim 8 wherein said body has a hydrodynamic shape.

10. The method set forth in claim 9 further including the step of applying epoxy material to said first and second cutouts to glue said first and second core members to said body.

* * * * *